United States Patent [19]

Wegner et al.

[11] 4,006,077

[45] Feb. 1, 1977

[54] DEMETALLIZATION OF ASPHALTENE-CONTAINING PETROLEUM HYDROCARBONS

[75] Inventors: Hans-George Wegner, Toppenstedt; Wolfgang Krüger, Bruhl; Günter Söchtig, Oststeinbek; Günter Brandes, Hamburg, all of Germany

[73] Assignee: Deutsche Texaco Aktiengesellschaft, Hamburg, Germany

[22] Filed: May 16, 1975

[21] Appl. No.: 578,283

[52] U.S. Cl. ..... 208/251 H; 208/251 R

[51] Int. Cl.[2] ..... C10G 25/00

[58] Field of Search ..... 208/251 H, 251 R

[56] References Cited

UNITED STATES PATENTS

| | | | |
|---|---|---|---|
| 2,905,625 | 9/1959 | Berger | 208/251 H |
| 3,530,066 | 9/1970 | Kuwata et al. | 208/251 H |

*Primary Examiner*—D. Horwitz

*Assistant Examiner*—James W. Hellwege

*Attorney, Agent, or Firm*—T. H. Whaley; C. G. Ries; Robert Knox, Jr.

[57] ABSTRACT

Metals are removed from metal- and asphaltene-containing petroleum oils by contacting the oil with pellets of sorptive type attapulgus clay which has been extruded and then dried at a temperature between about 100° and 650° C. to a volatile content of less than 20 weight %.

8 Claims, No Drawings

DEMETALLIZATION OF ASPHALTENE-CONTAINING PETROLEUM HYDROCARBONS

This invention relates to a process for the demetallisation of asphaltene-containing petroleum hydrocarbons in the presence of an argillaceous mineral derived from attapulgite.

Numerous continuous processes for the catalytic hydrogenation of asphaltene-containing petroleum hydrocarbons are known. Unless these processes are preceded by a special treatment or are carried out in the presence of a hydrogenation catalyst which has a higher resistance to poisoning than have the conventional hydrogenation catalysts, they have the additional disadvantage that deactivation of the hydrogenation catalyst during the hydrogenation reaction under the process conditions is accelerated not only by coke deposits but also by deposits of metals such as vanadium, nickel, iron, in some cases copper, zinc and sodium which are present in the charge in the form of oil-soluble organometallic compounds.

In contrast with the coke deposits, the metals deposited on the hydrogenation catalyst cannot be removed by oxidative regeneration, for example, with a mixture of steam and air, and thus lead to a permanent loss of activity of the catalyst. Since the catalyst cannot be restored to its original activity by regeneration the active life of the catalyst is thus further reduced. This means that, provided the effect of the hydrogenation remains constant, the cycles of regeneration per unit time, that is to say, the idle periods of the reactor per unit time, increase disproportionately at each additional regeneration. This effect occurs also where duplicate reactors are used despite the fact that the periods for which the reactor is inoperative are considerably shortened. The term "duplicate reactors" applies to two parallel reactors which may be changed over from one to the other, that is to say a stream of material may be diverted from one to the other reactor. In some known processes, which may also be operated with duplicate reactors, the catalysts are discarded when the maximum allowable deactivation as determined by the results of the hydrogenation is reached to avoid long periods during which the reactor is inoperative. In cases where asphaltene-containing petroleum hydrocarbon charges are used, the economy of the known processes is adversely affected by deposits of metal on the catalyst leading to further inactivity of the catalyst which cannot be regenerated, since the life of the catalyst depends upon the specific properties of the asphaltene-containing petroleum hydrocarbon charge, such as viscosity, asphaltene and metal contents and upon the particular reaction conditions employed.

Moreover, the presence of vanadium on the catalyst when a mixture of steam and air is used for the regeneration, results in the formation of vanadium pentoxide which accelerates the oxidation of sulphur trioxide. The latter, combined with the humid atmosphere in the reactor, causes sulphation of the supporting material of the catalyst and this results in a non-regenerable further deterioration of the latter.

Finally, the presence of vanadium, for example, in fuel oils, causes damage by corrosion of the fuel-oil burning installations.

Other known processes are employed in an attempt to prevent or at least to mitigate the aforedescribed disadvantages resulting from the hydrogenation catalyst being laden with metal when petroleum hydrocarbon charges are used. In these processes, the asphaltene-containing charge is subjected, for example, to a catalytic refining treatment in two stages, the first stage serving generally as a preliminary treatment of the charge for a partial removal of the asphaltenes and metals with more or less pronounced phenomena of cracking, in order to extend the active life ot the actual hydrogenation catalyst in the second stage. Known single-stage processes operate with special catalysts which have a higher adsorption capacity for metal and coke deposits than have the conventional sulphur-resistant hydrogenation catalysts and thus lead to an extended life of the respective catalyst system.

Thus, for example, German Auslegeschrift No. 1,770,996 describes a process for a catalytic refining of asphaltene-containing petroleum hydrocarbon charges in two stages, in which the charge is initially treated in the presence of a metal-containing porous catalyst, which may contain alumina and/or silicon dioxide, for the removal of asphaltene and metal components, and is then subjected to a catalytic hydrorefining treatment in a second stage. In a two-stage process described in U.S. Pat. No. 3,180,820 for the hydrorefining of, for example, asphaltene-containing heavy oils, a solid hydrogenation catalyst comprising nickel and molybdenum on a porous, refractory support of alumina and silicon dioxide is used.

German Offenlegungeschrift No. 2,235,954, describes a catalyst based on manganese nodules for the demetallisation of a hydrocarbon charge, and German Pat. No. 939,278 describes a process for the desulphurisation of crude oils by a catalytic pressure hydrogenation in which the crude oil before being subjected to a refining hydrogenation with subsequent removal of the ash to an extent not described in detail, is passed over a large-surface material, such as Raschig rings made of a clay not specified in detail, in which the clear space between and internally of the rings amounts to 65% of the total reactor space. The removal of vanadium over bauxite to an unspecified extent is described British Pat. No. 736,782. Also, a process in which the asphaltene-containing pertroleum hydrocarbon charge is treated with a liquid acting as a hydrogen donor and with a highly porous inorganic adsorption agent at the incipient temperature of formation of coke is described in German Offenlegungsschrift No. 2,142,818. Among other adsorption agents, attapulgite is used. However, the form in which it is used is not defined in detail and the treatment with the inorganic adsorption agent is carried out either subsequent to or simultaneously with the treatment with a hydrogen donor.

All of these processes have in common the disadvantage that the asphaltene-containing charges are incompletely demetallised and/or the catalyst used in the pretreatment of the charge causes additional expense and the profitability and economy of the known processes are thus doubtful.

It is therefore an object of the invention to provide a process by which the disadvantages of conventional demetallisation processes operating with asphaltene-containing petroleum hydrocarbon charge stocks may be avoided by a demetallisation involving moderate and controllable phenomena of cracking of the asphaltene-containing charge so that, when the demetallised charge is subjected to further processing by, for example, catalytic desulphurisation, hydrocracking, catalytic cracking, reformating or isomerisation and the like, deactivation of the catalyst is not caused by metal deposits but is caused merely by coke deposits thereby permitting the catalyst to be regenerated in situ, thus being, in effect, comparable to the treatment of an asphaltene-free distillate fraction.

This object is achieved by a process for the demetallisation of petroleum hydrocarbon charges comprising metals, asphaltenes and sulphur as impurities which is carried out in the presence of an argillaceous mineral derived from attapulgite, and in which the charges are passed through a bed consisting of attapulgus clay in its sorptive form, and in which the clay obtained from the attapulgite is coarse-crushed and the non-argillaceous constituents are then removed therefrom, after which the clay is extruded and then dried at a temperature in the range 100°–650° C, to a point where it contains less than 20% by weight of volatile constituents.

Surprisingly, it has been found that a commercially available argillaceous mineral derived from attapulgite or palygorskite is suitable for demetallisation under the process conditions employed. Many different grades of this argillaceous mineral are commercially available under the mark "Attapulgus clays." The wide range of applications of attapulgus clays, for example, in colloidal form, in the preparation of dispersing agent, coatings, adhesives and in the flushing of explorations, in the sorptive form for decoloration, paper recovery, conditioning, filtering aids, cleaning agents, for example, resins polymers, alkylates, and esters, or as catalytic charge material for refining mineral oil and in chemical processes is well known. Surprisingly, it was found that attapulgus clays, especially in their sorptive forms, are very suitable for demineralizing asphaltene-containing crude oil hydrocarbon feed in that first the metals are probably released by mild and controlled cracking reactions and subsequently the metals are adsorbed.

Ideally, attapulgite or palygorskite is a crystalline magnesium hydrosilicate in which in actuality, however, the magnesium is partially replaced by aluminium and iron.

As mined or extracted, natural silicate comprises from 70% to 80% of attapulgite, from 10% to 15% of montmorrillonite, sepiolith and other clays, from 4 to 8% of quartz and from 1% to 5% of calcite or dolomite. Other argillaceous constituents are, however, removed during the production and dressing of the attapulgus clays. Colloidal and sorptive grades are differentiated according to the thermal treatment to which they have previously been subjected.

After the removal of the volatile constituents, the typical analytical data of the attapulgus clays so produced are as follows:

| | | |
|---|---|---|
| Silicon | $SiO_2$ | 68 % |
| Aluminium | $Al_2O_3$ | 12 % |
| Magnesium | MgO | 10.5 % |
| Iron | $Fe_2O_3$ | 5.0 % |
| Calcium | CaO | 1.7 % |
| Phosphorus | $P_2O_5$ | 1.0 % |
| Potassium | $K_2O$ | 1.0 % |
| Titanium | $TiO_2$ | 0.7 % |
| Trace elements | | 0.1 % |

Two essential properties are derived from the structure of the attapulgite. Since its structure consists of three-dimensional chains, attapulgite is incapable of swelling to the same degree as clays of the montmorillonite type which have a three-layered structure. Furthermore, the fissionability along the Si—O—Si bonds, by which the bands are held together, imparts to the particles an unusual needle-shaped form.

The degree of effectiveness of the respective attapulgus clays in one of the possible applications cited is dependent upon the amount of water still present therein after the thermal treatment. Uncombined water will be expelled by a thermal treatment at a temperature up to 100° C. When the thermal treatment is continued at a temperature exceeding 100° C, and up to about 650° C. the water present in the pores is removed first, the water of crystallisation and the water of constitution being removed subsequently. In the process according to the invention, sorptive - grade attapulgus clays are used, that is, clays which have been dried at a temperature of over 100° C. and up to 650° C., preferably at a temperature between 150° and 400° C. The effectiveness of the clays is also affected by the preliminary mechanical treatment which has been carried out optionally under an elevated pressure. In the preocess according to the invention, the extruded attapulgite products, which are given preference over the natural products, have a particle size ranging between 4.76 and 2.38 mm width of mesh to between 0.297 and 0.177 mm width of mesh, preferably between 2.38 mm and 1.19 mm width of mesh. The sorptive-grade attapulgus clays are produced by mixing the coarse-crushed attapulgite, from which the non-argillaceous constitutents have been removed, with water and then subjecting the mixture to an extrusion process. This is followed by a thermal treatment at a temperature in the range 100°–650° C., preferably in the range 150°–400° C.

Typical physical properties of several attapulgus clays are compiled in Table I.

In accordance with the invention, the demetallisation of asphaltene-containing petroleum hydrocarbons may be carried out batchwise or continuously. In the continuous process, known techniques, such as fixed bed, fluidized bed, ebullating bed and moving bed may be employed. In order to ensure continuous operation and continuous processing, it may be advisable to operate with at least two reactors, which are used optionally simply by switching from one reactor to the other until the activity of the attapulgus clay used in one of the reactors is exhausted to such an extent that the metals set free from the asphaltene-containing charge are no longer removed completely. This is followed by switching to the second reactor as the contents of the first reactor are either regenerated or worked up for the recovery of the metals present therein.

The demetallisation of the asphaltene-containing petroleum hydrocarbon charge is preferably carried out under the following reaction conditions:

| | |
|---|---|
| Temperature | 200°–500° C. |
| Pressure | < 300 bar |
| Space flow velocity | 0.1–5.0 v/v/hr |
| Recycle gas | 100–5000 $Nm^3/m^3$ |
| Purity of the hydrogen | > 50 % by volume |

The optimum reaction conditions are adjusted by a combination of various reaction conditions within the specified limits dependent upon the properties of asphaltene-containing petroleum hydrocarbon charged so that substantially complete demetallisation may be ensured.

While it is not absolutely necessary for the demetallisation of the charge to be carried out in the presence of hydrogen, it is advisable to use hydrogen, particularly where the demetallised charge of reduced asphaltene content is to be subjected to further processing, for example, to catalytic hydrodesulphurisation, since it is then desirable to obtain the preliminary saturation effect of the hydrogen present in the charge in the zone of demetallisation (see German Offenlegungsschrift No. 2,215,685).

The charge may be conducted either in a downward or upward direction, in parallel with or in counterflow to the hydrogen in the demetallisation reactor, using a single reactor, but preferably at least two reversible reactors or a plurality of series-connected reactors and a duplex or duplicate reactor.

Asphaltene-containing petroleum hydrocarbon charges include, for example, atmospheric residual oils, vacuum residual oils, heavy gas oils or fuel oils, shale oil, tar sand oil, crude oils and the like and mixtures thereof.

EXAMPLE 1

The commercially-available supporting materials and catalysts listed in Table II were compared in respect of their adsorption capacities for the metals set free under the specified conditions from an asphaltene-containing atmospheric residuum containing 30 ppm vanadium.

The tests were carried out in a 0.5 liter autoclave filled with 25 grams of the respective materials and 25 ml. of the atmospheric residual oil for a period of two hours at 300° C and a hydrogen pressure adjusted to 100 bar.

The compilation of the results in Table II shows that the quality of the extruded attapulgus clays was superior to their natural quality and the capacity of the extruded clays to adsorb the vanadium set free under the reaction conditions from the atmospheric residual oil was at least equal to that of metal-containing, commercially available catalysts and two activated bauxites containing respectively 2% and 6% of volatile constituents, and also superior to a special aluminium silicate based on montmorillonite, whilst the natural qualities of attapulgus clays were comparable to various qualities of $Al_2O_3$ and a selected quality of $SiO_2$ as far as their adsorption capacity was concerned. The remaining materials mentioned in the Table had a relatively lower adsorption capacity for metal. A comparison between the attapulgus clays shows clearly the influence of the quality, that is, the natural quality or the quality in the extruded form, and of the proportion of volatile constituents (I or II, see Table I) upon the capacity of the sorptive attapulgus clays to adsorb metals set free.

EXAMPLE 2

The supporting materials selected at random on the basis of the tests carried out in the autoclave and having been found to be suitable for the removal of metals set free from atmospheric residual oil under the specified process conditions, were again used and tested in a short-time test program (50 hours) carried out in a continously operating fixed-bed reactor, in which the same charge as that used in Example 1 was passed with hydrogen downwardly through the reactor.

The reaction conditions were 400° C., 100 bar and 0.5 v/v/hr using 3500 $Nm^3/m^3$ of recycle gas. The results of these tests are shown in Table III which shows the viscosity at 99° C, the asphaltene content, the Conradson carbon and the sulphur, vanadium and nickel contents as compared with the corresponding values for the charge.

The test results show clearly that the attapulgus clays tested were superior to the other supporting materials as far as their capacity of removing the metals set free from the oil charged, such as vanadium and nickel, and the asphaltene content and the Conradson value were substantially below the initial values, whilst the sulphur content decreased from 2.9% by weight to 2.45% by weight. In the case of the extruded attapulgus clays (width of mesh from 2.38 to 1.19 mm) and normal and lower contents of volatile constituents, about 25% to 30% of the charge boiling above 343° C., were converted into lighter hydrocarbon fractions (<343° C.).

EXAMPLE 3

The activity and effectiveness of the relevant attapulgus clays with respect to their adsorption capacity for the metals set free under the process conditions from the asphaltene-containing petroleum hydrocarbon charge were tested in a 300 hour test run in which two fixed-bed reactors R1 and R2 were used, and in which the asphaltene-containing charge was passed in parallel flow with hydrogen downwardly through the reactors and the effluent from Rl served as a charge for R2.

The first reactor, filled with extruded attapulgus clay (width of mesh from 2.38 to 1.19 mm) which contained the normal amount of volatile constituents, was operated under the following conditions:

| | | |
|---|---|---|
| R1 - | temperature | variable |
| | pressure | 100 bar |
| | space velocity | 0.25 v/v/hr |
| | recycle gas | 2500 $Nm^3/m^3$ of oil |

The second reactor was filled with a commercially available cobalt molybdate on alumina desulphurisation catalyst. The reaction conditions were as follows:

| | | |
|---|---|---|
| R2 - | temperature | 360° C. |
| | pressure | 100 bar |
| | space velocity | 0.5 v/v/hr |
| | recycle gas | 2500 $Nm^3/m^3$ of oil |

Two comparative runs were made under the following conditions:

COMPARATIVE RUN 1

This run was carried out in a reactor filled with the same catalyst as that used in reactor 2 of the test run, at 360° C., 100 bar, 0.5 v/v/hr and under otherwise the same conditions as those used in the 300 hour test run.

COMPARATIVE RUN 2

This run is similar to the test run of Example 3 except that the first reactor R1 was filled with a mixture of $Al_2O_3$ and $SiO_2$ in a ratio of 2:1 and operated at 350° C., 100 bar and 0.5 v/v/hr. The second reactor R2 was filled with the same catalyst as that used in the 300 hour test run and operated at 380° C., 100 bar and 1.5 v/v/hr.

The results of the test run and those of comparative runs 1 and 2 are compiled in Table IV which shows also the characteristic data of the charge, an atmospheric residue, which was the same in each run.

The results compiled in Table IV show 1. that the asphaltene-containing material charged in the first reactor R1 was substantially demetallised under the specified reaction conditions;
2. that the degree of demetallisation of the asphaltene-containing charge was controlled to a large extent by the temperature in reactor R1;
3. that a penetration of metal through R1 deliberately induced by lowering the temperature in reactor R1 could be stopped by increasing the temperature in reactor R1;
4. that the variations in the sulphur and asphaltene contents caused by changing the temperature in the reactor R1 varied directly with the changes in the metal contents in the pretreated charge;
5. that at the desired operating conditions the sulphur and asphaltene contents of the charge were reduced in reactor R1;
6. that the changes in the properties of the asphaltene-containing charge in reactor R1 and in reactor R2 ran parallel with each other, and the changes in the properties of the materials in reactor R2 reflected the changes in reactor R1,
7. that in the test run with a constant temperature in reactor R2, the desulfurization catalyst in reactor R2 showed no loss in activity after 300 hours.
8. that, in comparison therewith, after a period of 50 hours the sulphur content in comparative run 1, which was operated at 360° C., 100 bar and 0.5 v/v/hr using the same catalyst and the same charge as in the test run, was 1% by weight as compared to the test run with 0.8% by weight of sulphur and, after a period of 300 hours, increased to 1.2% by weight, whereas the sulphur content in the test run was only 0.6% after 300 hours;
9. that, as a result of the use of extruded attapulgus clay (width of mesh 2.38 – 1.19 mm), the effect of the preliminary treatment of the asphaltene-containing charge was more effective than that obtained in Comparative Run 2, in which a mixture of $Al_2O_3$ and $SiO_2$ *in a ratio of* 2:1 was used in reactor R1;
10. that in both Comparative Runs 1 and 2 the hydrogenated product had substantially the same vanadium content after the catalytic hydrogenation independently of the various process and reaction conditions employed;
11. that, in Comparative Run 2 the contents in reactor R1 had an inadequate adsorption capacity for the metals.

Table V shows the portions of cracked products obtained in the test run.

Table V

| | R1 = 340° C<br>R2 = 360° C | R1 = 370° C<br>R2 = 360° C | R1 = 380° C<br>R2 = 360° C |
|---|---|---|---|
| Gas Yield, wt. % | 1.1 | 1.6 | 3.0 |
| < 200° C., wt. % | 1.8 | 2.8 | 3.1 |
| 200 – < 343 wt. % | 11.7 | 14.8 | 15.8 |
| > 343° C. wt. % | 85.4 | 80.8 | 77.9 |

These results show that the two-stage catalytic hydrogenation of asphaltene-containing charges described in Example 3 proceeded under mild cracking reactions and the proportion of unchanged charge (>343° C) decreased slowly with increasing temperature in reactor R1 whilst the proportions of gas, naphtha and intermediate distillates increased correspondingly.

TABLE I

| | Sorptive-grade Attapulgus Clays<br>I | II | III |
|---|---|---|---|
| Free moisture Loss at 105° C. % | 6 – 7 | 0 – 1 | 0 – 1 |
| Volatile constituents (moisture-free base) Loss at 650° C. % | 9 | 5 | 5 |
| Specific gravity | 2.3 – 2.5 | 2.3 – 2.5 | 2.3 – 2.5 |
| Apparent density, shaken or vibrated, kg/L | 0.45 – 0.58 | 0.45 – 0.58 | 0.45 – 0.58 |
| Effective surface B.E.T. sq.m/gram | 125 – 135 | 125 – 135 | 125 – 135 |
| Particle size | granular | granular | granular |
| Oil absorption, wt. % | 80 – 135 | 125 – 140 | 140 – 190 |

T = normal content of volatile constituents
II = low content of volatile constituents
III = very low content of volatile constituents.

TABLE II

| Material | Residual content of vanadium in the residue, ppm. |
|---|---|
| Co 5% – Mo 13.5% on $Al_2O_3$ | 19 |
| Ni 4% – Mo 10% on active alumina | 6 |
| $Al_2O_3$- loss on ignition 5% | 6 |
| $Al_2O_3$ 99% – 250 A | 8 |
| $Al_2O_3$ 99% – 120 A | 8 |
| $Al_2O_3$ 93% – 60 A | 8 |
| $Al_2O_3$ 98% – 60 A | 7 |
| $Al_2O_3/SiO_2$ – 2:1 | 11 |
| $SiO_2$ loss on ignition 2% – 4% | 8 |
| $SiO_2$ loss on ignition 1% – 2% | 11 |
| Aluminium silicate | 12 |
| Aluminium silicate (base:montmorillonite) | 5 |
| Active bauxite 4.0 – 1.9[6] | 19 |
| Active bauxite 4.0 – 2.38 | 18 |
| Active bauxite 2.0 – 0.84 2%[1] | 6 |
| Active bauxite 3.0 – 0.84 6%[1] | 6 |
| Attapulgus clay 2.38 – 1.19 | 4 |
| Attapulgus clay 2.38 – 1.19[3] | 8 |
| Attapulgus clay 2.38 – 1.19[4] | 9 |
| Attapulgus clay 2.38 – 1.19[5] | 2 |
| Activated alumina | 11 |

1) with volatile constituents
2) extruded, I (see Table I)
3) natural product, II (see Table I)
4) natural product, I (see Table I)
5) in extruded form, II (see Table I)

TABLE II-continued

| Material | Residual content of vanadium in the residue, ppm. |
|---|---|
| 6) width of mesh in mm. | |

TABLE III

| | S wt% | Viscosity 99° C cst | Ni ppm | V ppm | Conradson wt% | Asphaltenes wt% |
|---|---|---|---|---|---|---|
| Charge | 3.0 | 26.9 | 9 | 30 | 8.5 | 2.6 |
| $Al_2O_3$ 99% – 250 A | 2.8 | 9.4 | 6 | 22 | 7.7 | 2.1 |
| $Al_2O_3$ 99% – 120 A | 2.84 | 13.4 | 5 | 24 | 8.1 | 2.9 |
| $Al_2O_3$ 93% – 60 A | 2.83 | 10.5 | 0 | 12 | 6.9 | 2.5 |
| $Al_2O_3$ | 2.65 | 12.0 | 6 | 21 | 7.3 | 3.0 |
| $SiO_2$ 2 – 4% volatile constituents | 2.87 | 14.3 | 6 | 23 | 8.3 | 2.6 |
| $SiO_2$ 1 – 2% volatile constituents | 2.85 | 14.9 | 5 | 23 | 8.6 | 3.3 |
| Aluminium silicate | 2.70 | 14.0 | 8 | 20 | 8.3 | 2.5 |
| Aluminium silicate (base: montmorillonite) | 2.50 | 10.0 | 4 | 11 | 5.9 | 1.8 |
| Active bauxite 2.0 – 0.84[6] 2%[1] | 2.80 | 10.1 | 3 | 9 | 6.8 | 2.3 |
| Active bauxite 2.0 – 0.84 6%[1] | 2.70 | 10.6 | 4 | 7 | 6.6 | 2.2 |
| Attapulgus clay 2.38 – 1.19[2] | 2.45 | 6.6 | 0 | 0 | 5.1 | 0.9 |
| Attapulgus clay 2.38 – 1.19[3] | 2.75 | 9.5 | 3 | 12 | 6.5 | 2.3 |
| Attapulgus clay 2.38 – 1.19[4] | 2.85 | 8.8 | 2 | 7 | 6.3 | 2.1 |
| Attapulgus clay 2.38 – 1.19[5] | 2.45 | 7.6 | 0 | 0 | 3.6 | 0.9 |
| Attapulgus clay 4.76 – 2.38[3] | 2.7 | 10.3 | 4 | 14 | 7.0 | 2.3 |

For 1) – 6) see notes in Table II.

TABLE IV

| Number of hours | Original Charge | 50 | 100 | 120 | 150 | 200 | 300 |
|---|---|---|---|---|---|---|---|
| Reactor R1 test run | | 360° C | 370° C | 340° C | 360° C | 370° C | 380° C |
| Sulphur, % | | 2.55 | 2.55 | 2.95 | 2.8 | 2.7 | 2.55 |
| Vanadium, ppm | | 0 | 0 | 11 | 5 | 0 | 0 |
| Nickel, ppm | | 0 | 0 | — | — | 0 | 0 |
| Asphaltenes, | | 1.5 | 1.4 | 2.6 | | | |
| Reactor R2, test run | | 360° C | 360° C | 360° C | 360° C | 360° C | 360° C |
| Sulphur, % | 3.0 | 0.8 | 0.6 | 1.0 | 0.8 | 0.7 | 0.6 |
| Vanadium, ppm | 30 | 0 | 0 | 3 | 1 | 0 | 0 |
| Nickel, ppm | 9 | 0 | 0 | — | — | 0 | 0 |
| Asphaltenes, % | 2.6 | 0.7 | 0.6 | 1.6 | 1.1 | 0.7 | 0.4 |
| Visc./99° C, cst | 26.9 | 9.1 | 6.5 | 13.9 | 8.8 | 6.1 | 4.4 |
| Comparative Run 1 | | | | | | | |
| Sulphur, % | | 1.0 | 1.0 | 1.0 | 1.10 | 1.15 | 1.20 |
| Vanadium, ppm | | 14 | — | — | — | 16 | 18 |
| Comparative Run 2 | | | | | | | |
| Sulphur, % | | 0.65 | 0.75 | 0.75 | 0.80 | 0.95 | 1.0 |
| Vanadium, ppm | | 14 | — | — | — | 16 | 16 |

The embodiments of the invention in which an exclusive property or privilege is claimed are defined as follows:

1. A process for the removal of metals from petroleum hydrocarbon charge materials containing metals and asphaltenes as contaminants in the presence of a clay mineral comprising contacting the charge materials at a temperature between about 200° and 500° and a pressure between about 1 and 300 bar in the presences of hydrogen with sorptive type attapulgus clay which has been extruded and then dried at a temperature between 100° and 650° C. until it contains less than 20 wt. % volatile components.

2. A process according to claim 1 in which the attapulgus clay is dried at a temperature between 150° C. and 400° C.

3. A process according to claim 1 in which the clay is extruded through an opening having a maximum cross-sectional dimension not greater then 4.76 mm. and a minimum cross-sectional dimension not less than 0.177 mm.

4. A process according to claim 3 in which the maximum cross-sectional dimension is not greater than 2.38 mm. and the minimum cross-sectional dimension is not less than 1.19 mm.

5. A process according to claim 1 in which the contacting is carried out in the presence of hydrogen.

6. A process according to claim 1 in which the charge materials are passed through a particulate bed of said sorptive type attapulgus clay at a space velocity between about 0.1 and 5.0 v/v/hr. and in the presence of hydrogen introduced at a rate between about 100–5000 $Nm^3$ per $m^3$ of charge materials.

7. A process according to claim 6 in which the particles have a maximum cross-sectional dimension not greater than 4.76 mm. and a minimum cross-sectional dimension not less than 0.177 mm.

8. A process according to claim 7 in which the particles have a maximum cross-sectional dimension not greater than 2.38 mm. and a minimum cross-sectional dimension not less than 1.19 mm.

* * * * *